United States Patent [19]

Sharp

[11] 4,301,969

[45] Nov. 24, 1981

[54] OXYGEN LANCE NOZZLE

[76] Inventor: Kenneth C. Sharp, 8 De Brus Ct., Marine Parade, Saltburn by-the-sea, Cleveland, England

[21] Appl. No.: 124,560

[22] Filed: Feb. 25, 1980

[51] Int. Cl.[3] ..... B05B 15/00

[52] U.S. Cl. ..... 239/132.3; 266/225

[58] Field of Search ..... 239/132.3, 127.1, 132, 239/132.1, 397.5; 266/135, 137, 225, 226; 75/59

[56] References Cited

U.S. PATENT DOCUMENTS 3,201,104 8/1965 Berry ..... 239/132.3

3,385,587 5/1968 Smith ..... 239/132.3

4,052,005 10/1977 Rymarchyk ..... 266/225

*Primary Examiner*—James B. Marbert

*Attorney, Agent, or Firm*—McWilliams, Mann & Zummer

[57] ABSTRACT

This invention relates to apparatus for manufacturing steel from molten iron and in particular, it relates to a lance of the type used in steel making utilizing a method involving a blown stream of oxygen, having a nozzle cooled by pipes symmetrically disposed in the nozzle with certain pipes extended to cool a central portion of the nozzle.

3 Claims, 2 Drawing Figures

OXYGEN LANCE NOZZLE

BACKGROUND OF THE INVENTION

A typical oxygenating process is the LD process in which a long tube, called a lance, is used to conduct high pressure oxygen onto the surface of molten iron in a converter. A typical lance may be approximately seventy five feet in length, or thereabout and has a nozzle close to the molten iron that is usually made of copper.

The oxygen lance nozzle is subject to very high temperatures, in excess of 2000° C. when operating in a converter vessel, and its survival is due solely to the cooling arrangement utilized to reduce the temperature of the nozzle. The cooling arrangement conventionally applied to the lance nozzle typically included water jackets around the oxygen supply bore; these jackets defined annular water conduits for the inlet and outlet of cooling water.

In order for the cooling water to have an appreciable effect it was necessary that the copper walls between the surface of the lance tip and the cooling water be relatively thin. However, the copper walls are eroded during operation, with the possibility that dangerous water ingress into the converter became highly probable. This danger is compounded by the fact that the cooling water is supplied at relatively high pressure to obtain the necessary transfer of heat.

SUMMARY OF THE INVENTION

This invention provides an oxygen lance nozzle having at least one pipe to cool the walls of the nozzle and preferably a plurality of such cooling pipes are provided around a central bore through which a supply of oxygen is blown onto the molten iron, to afford adequate cooling effect and thus prolong the life of the nozzle. The bore through which oxygen is supplied is formed of a plurality of outlet venturi tubes at the lance tip, which are narrower than the main bore to obtain maximum penetration and combustion efficiency. Typically, four such venturi tubes are utilized for the desired results.

OBJECTS OF THE INVENTION

The primary purpose of the present invention is to provide an improved form of nozzle for an oxygen lance.

The principal object of the present invention is to provide a nozzle for an oxygen lance having at least one cooling pipe operative to cool the walls of the nozzle.

An important object of the invention is to form a number of cooling pipes around a central bore through which oxygen is supplied, the cooling pipes being connected with a source of cooling fluid at their condensing ends.

A more specific object of the invention is the provision of a lance nozzle wherein the nozzle wall at its tip comprises a relatively thick portion of copper, into which the evaporating ends of the cooling pipes are inserted.

A still more specific object of the invention is realized in an oxygen lance and nozzle wherein the oxygen tube is arranged to feed a number of venturi tubes passing through the thick portion of the copper nozzle and which venturi tubes are lined with ceramic inserts.

A further object of the invention is the provision of a lance nozzle having a number of cooling pipes equally spaced about a central bore, through which oxygen is supplied, with the cooling pipes curved inwardly to cool the center area of the nozzle and connected with a source of cooling fluid at their condensing ends.

DESCRIPTION OF THE DRAWINGS

An embodiment of the invention will now be described with reference to the accompanying drawings, wherein.

DESCRIPTION OF PREFERRED EMBODIMENT

Figure 1:
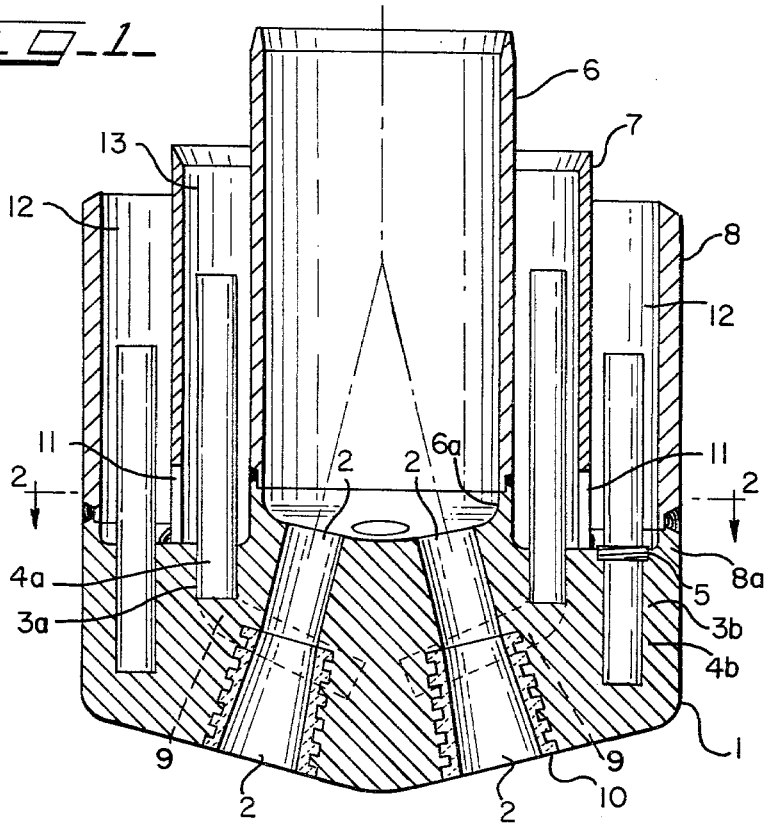
FIG. 1 is an axial section through the nozzle of an oxygen lance.
Figure 2:
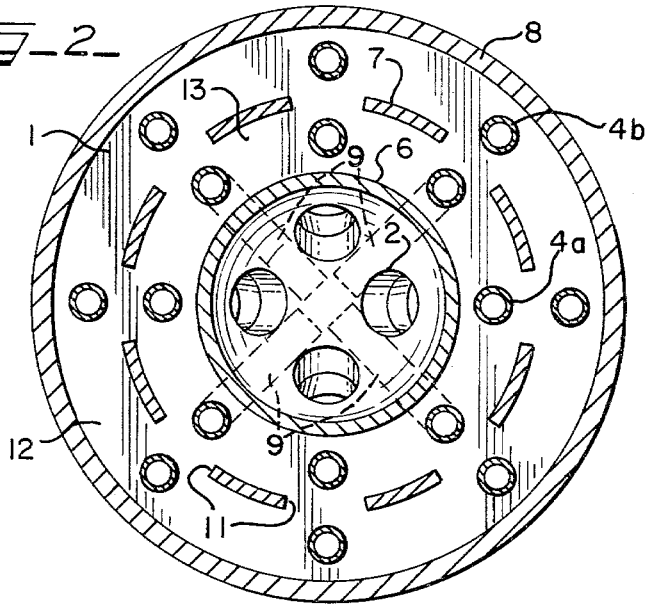
FIG. 2 is a transverse section through the nozzle, taken on the line 2—2 of FIG. 1.

Referring to the drawings, a nozzle for an oxygen lance is formed from a block of copper 1, which may be a solid casting, or a forged solid block. Four venturi tubes 2 are bored through the block at angles symmetrically disposed about its centre and further, closed bores 3*a* and 3*b* are bored into the block to form two circularly spaced arrays around the centre of the copper block 1, outwardly of the venturi tubes 2 as best shown in FIG. 2. The closed bores 3*a* and 3*b* receive cooling pipes 4*a* and 4*b* respectively. Alternate bores 3*a* have inwardly curved portions 9 that extend generally toward the central area of the solid copper block 1 to cool this central portion of the nozzle. These bores 3*a* extend between the venturi tubes 2 and the cooling pipes 4*a* extend the full depth of the bores 3*a* so that their evaporating ends obtain the most effective cooling action. Both the cooling pipes 4*a* and 4*b* are secured in the bores 3*a* and 3*b* by welding or alternatively be screw threads, as at 5 and serve to conduct heat from the copper block 1 into a supply of cooling water with which the cooling pipes are connected at their condensing ends. The cooling pipes 4*a* and 4*b* are, of course, hollow, as best shown in FIG. 2, to conduct the cooling water and obtain the greatest cooling effect.

An oxygen supply pipe 6 is fixedly secured to a corresponding flange 6*a* formed on the copper block 1 around the exterior of the venturi tubes 2. The pipe 6 is welded to the flange 62 to fix it in its correct location. A return water channel 13 is provided by a sleeve 7 located around the oxygen pipe 6 which defines the central bore and which is also welded to the copper block 1. At its edge adjacent the copper block 1 the water sleeve 7 has a number of openings 11 through which the cooling water flows from an inlet water chamber 12, defined by an outer sleeve, or water jacket 8, which is welded to a peripheral flange 8*a* on the copper block 1 and which forms a chamber that is supplied with water under pressure from a suitable source.

The lance nozzle as described, can be fitted to existing lances but requires considerably less water pressure to provide sufficient cooling to the evaporating ends of the cooling pipes than that required for conventional water cooling.

To increase the life of the nozzle still further, the inner surface of each of the venturi tubes 2 may be lined with a removable refractory insert 10 which may be replaced due to wear. It will be appreciated that such inserts are possible only because of the greatly increased thickness of the present nozzle over conventional types of lance nozzles. It will also be appreciated that the differing depth of the bores 3*a* and 3*b* allows for the possibility of the walls of the nozzle being eroded back to the deepest cooling pipe, which would then no longer function, while the less deeply inserted cooling pipes would continue to function.

Various other configurations of the nozzle components may be used which further utilize the advantageous properties of the cooling pipes including provision for the water flow in the two channels 12 and 13 to be reversed.

What is claimed is:

1. An oxygen lance nozzle including a block of copper, a central bore for conducting a flow of oxygen to said block, a plurality of cooling pipes disposed in equally spaced relation around said central bore, said block of copper comprising a relatively thick tip for the nozzle with the ends of said cooling pipes mounted in said thick tip to conduct heat from the tip, certain of said cooling pipes diagonally opposed and curved inwardly toward the center of the nozzle to cool the central area of the nozzle, a plurality of venturi tubes extending through said tip and conducting oxygen through the tip, an oxygen supply pipe in communication with said central bore, a water sleeve surrounding said plurality of cooling pipes, and an outer water jacket surrounding the cooling pipes disposed between said sleeve and said jacket, both said sleeve and said jacket being secured to the thick copper tip of the nozzle, and said water sleeve provided with one or more openings affording communication through the sleeve between chambers formed by the outer jacket, the water sleeve and said supply pipe, said cooling pipes extending vertically into said chambers at opposite sides of said sleeve and cooling said tip by water from said chambers.

2. An oxygen lance nozzle as set forth in claim 1 wherein said venturi tubes are lined with ceramic inserts.

3. An oxygen lance nozzle as set forth in claim 2 wherein said cooling pipes ends are mounted in said thick tip at different depths.

* * * * *